United States Patent [19]

Fabbri et al.

[11] 4,242,723

[45] Dec. 30, 1980

[54] LOW LEVEL WORK AREA LIGHTING SYSTEM

[75] Inventors: William C. Fabbri, Billerica; Paul T. Metcalf, II, Methuen, both of Mass.

[73] Assignee: Keene Corporation, New York, N.Y.

[21] Appl. No.: 38,642

[22] Filed: May 14, 1979

[51] Int. Cl.[3] ..... A61G 13/00

[52] U.S. Cl. ..... 362/33; 362/224; 362/331

[58] Field of Search ..... 362/33, 224, 331

[56] References Cited

U.S. PATENT DOCUMENTS

| | | | |
|---|---|---|---|
| 3,222,515 | 12/1965 | Orr | 362/331 X |
| 3,288,990 | 11/1966 | Stahlhot | 362/331 X |

*Primary Examiner*—Stephen J. Lechert, Jr.

*Attorney, Agent, or Firm*—Kane, Dalsimer, Kane, Sullivan and Kurucz

[57] ABSTRACT

A work area lighting system is provided including a housing containing a linear light source therein and having an open bottom end. A refractor comprising a pair of refractor plate members closes the open bottom end. The refractor includes a first member having a plurality of spaced prisms extending parallel to the light source and a second having a plurality of spaced prisms extending perpendicular to the light source. The second member underlies the first member and both are co-extensive in length with the light source. The refractor plates each have light incident and light emergent surfaces and both plates have their prisms on the light incident surface.

6 Claims, 5 Drawing Figures

LOW LEVEL WORK AREA LIGHTING SYSTEM

BACKGROUND OF THE INVENTION

The present invention relates to lighting systems and in particular to an improved lighting system for lighting a work area with reduced glare and veiling reflections.

In U.S. Pat. No. 4,054,793 issued Oct. 18, 1977 to Sylvan R. Shemitz there is disclosed a desk level work area lighting system. As set forth in that patent, the object of such systems is to provide lighting whereby direct glare and veiling reflections are substantially eliminated from a task positioned at the work area. For this reason such lighting systems are commonly referred to as "task" lighting. The Shemitz patent utilizes a light fixture positioned above a desk. Light from a linear source (i.e., such as an elongated fluorescent tube) is reflected through a refractor member having prisms extending perpendicular to the light source. In order to reduce direct glare and veiling reflections on the desk top surface, the half bat wing configuration of luminous flux eminating from the fixture is directed to the right and left by the refractor member.

The sacrifice paid for eliminating glare and veiling reflections from the center of the work area is decreased illumination at the extremes of the desk. That is, when a person is sitting at the center of the desk and looks to his right or left, those areas will appear abnormally dark. To overcome this problem, the copending application Ser. No. 891,697 for Improved Work Area Lighting System commonly assigned with the present application proposes an arrangement of refractor plates which permits light flux distribution to be varied over the desk top as may be required. While improving the end-to-end light distribution there is some loss of front to back distribution. While the light could be spread by tilting the fixture, such tilting would pose problems of glare. That is, some fixtures are designed to permit their light sources to be tilted to throw out the light however, this may result in the bulb being exposed directly to the eyes of the worker at the station, particularly with low fixtures which would result in harsh glare.

In view of the above, it is the principal object of the present invention to provide an improved lighting system for a desk level work station capable of providing reduced direct glare and veiling reflections to the work station, while providing substantially uniform light distribution over the entire work station both from end-to-end and front to back.

A further object is to provide such a system which permits a lamp to be mounted closely to the top of a work surface and yet throws substantial light over the entire work surface.

Further objects and advantages will become evident from the following specification.

SUMMARY OF THE INVENTION

The above and other beneficial objects and advantages are attained in accordance with the present invention by providing an improved work area lighting system which comprises a housing adapted to be positioned above a desk level work area. The housing contains therein an elongated linear light source and includes an open bottom end. A refractor is mounted to the housing for refracting light produced by the source. The refractor comprises a pair of plates arranged one over the other including a refractor plate top member having a plurality of spaced prisms extending parallel to the linear light source and a bottom refractor plate member having a plurality of spaced prisms extending perpendicular to the linear light source. The bottom member and top member are co-extensive in length with the light source. The prisms on each of the members are contained on a surface of the member directed toward the light source.

DETAILED DESCRIPTION OF THE PREFERRED EMBODIMENT

Figure 1:
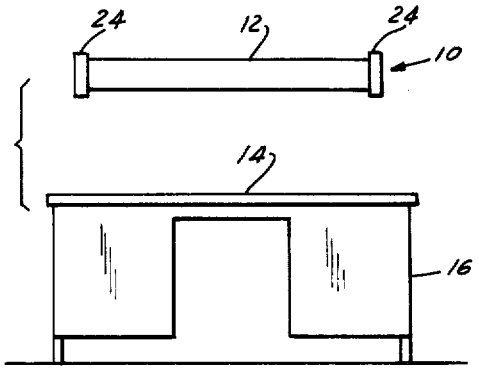
FIG. 1 is a partly diagrammatic, elevational view of a work station utilizing the lighting fixture of the present invention.
Figure 2:
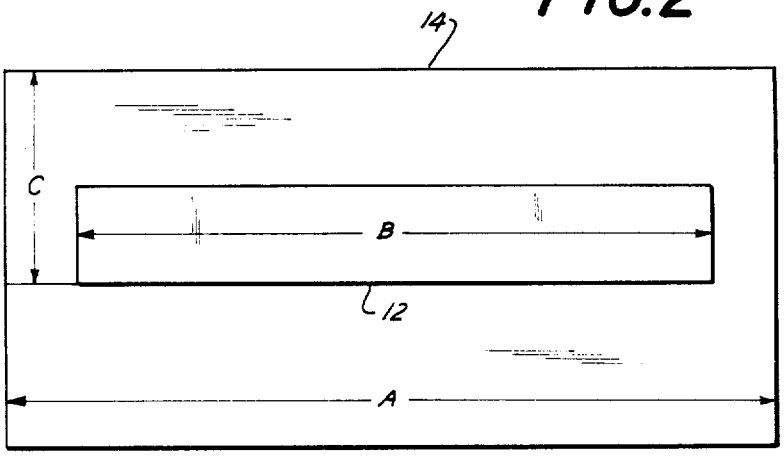
FIG. 2 is a top plan view of the work station of FIG. 1 showing the fixture superimposed over the work station top surface.

Reference is now made to the drawings and to FIG. 1 in particular wherein a lighting system 10 in accordance with the present invention is depicted. The system comprises a housing 12 containing therein an elongated fluorescent light tube to illuminate the top surface 14 of a work station or a desk 16. The housing 12 is typically mounted between 13" and 20" of desk 16. This permits the top surface of the fixture to serve as a shelf for books or the like. The fixture is generally 4 feet in length (B of FIG. 2) and preferably is centered along the length of the desk (A) which commonly is 5 feet long. For a standard desk 30 inches wide, the fixture should be mounted so that its front surface is approximately 13" from the rear of the desk (C).

Figure 4:
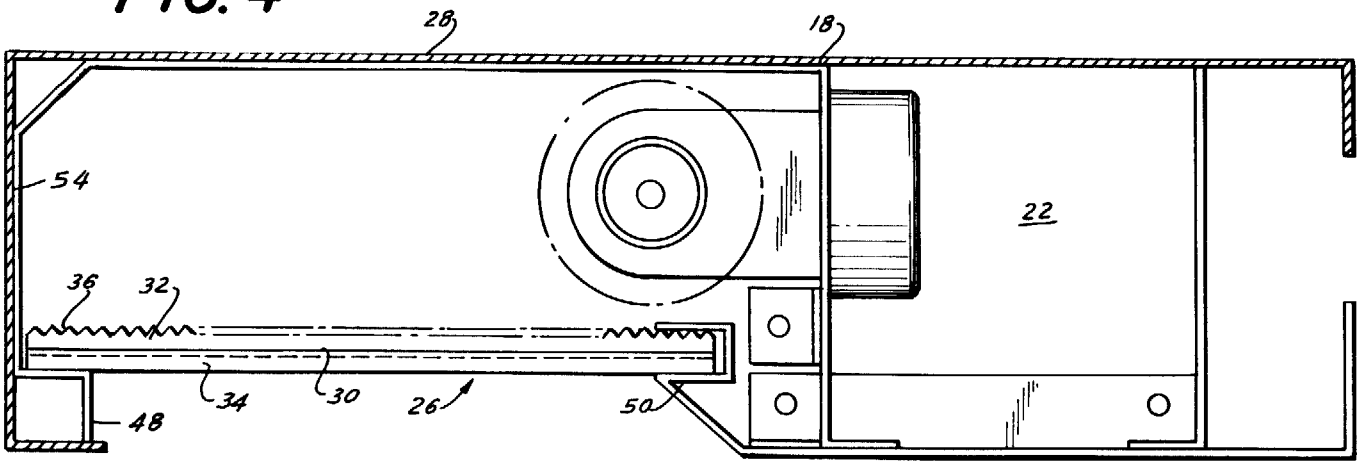
FIG. 4 is a side elevational sectional view of the lighting fixture of the present invention.
Figure 5:
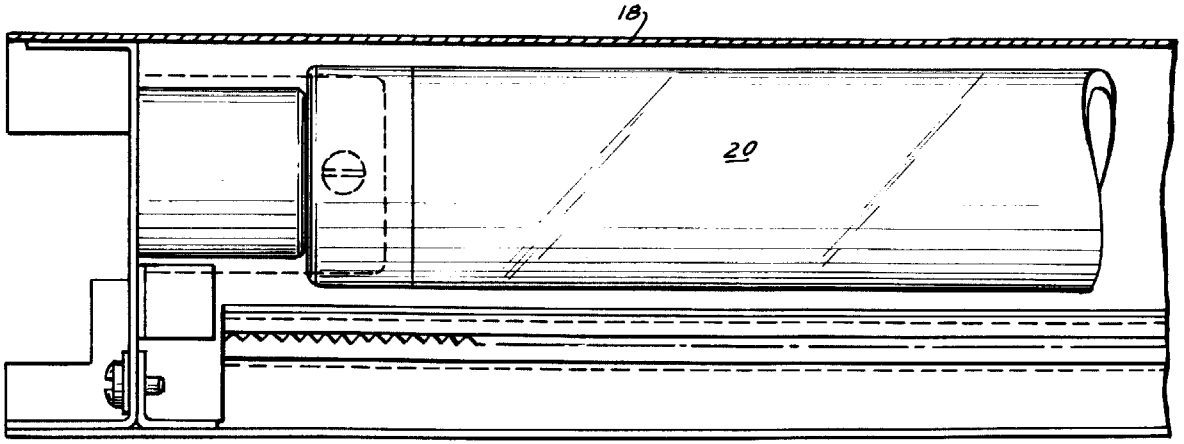
FIG. 5 is a fragmentary sectional view taken along reference line 5—5 of FIG. 4 in the direction indicated by the arrows.

Referring to FIGS. 4 and 5 it can be seen that the housing 12 comprises a sheet metal frame 18 containing therein an elongated fluorescent bulb 20 along with the necessary associated ballast 22 and wiring (not shown). The ends of the housing are closed off by end caps 24 to provide a uniform and finished appearance.

Figure 3:
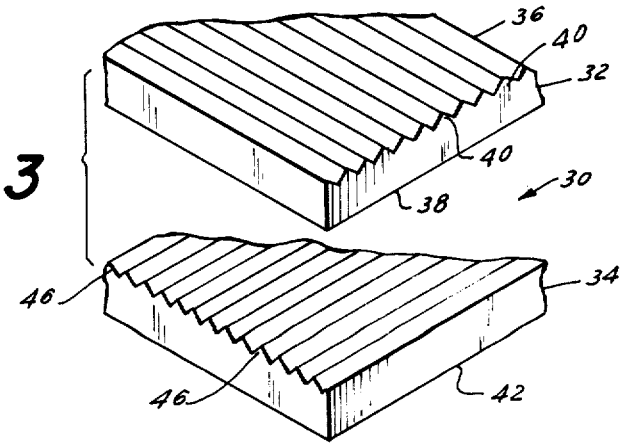
FIG. 3 is an exploded diagrammatic perspective view showing the refractor top and bottom plates along with the orientation of the prisms on the plates.

Referring to FIG. 4, it can be seen that the bottom 26 of the housing is open. The top end 28 is closed by portions of the frame and serves as a shelf. The bottom end 26 of the fixture is closed by a refractor assembly 30 (the details of which may be best seen in FIG. 3) which comprises a first refractor plate member 32 and a second refractor plate member 34. Both members 32 and 34 are formed from commercially available refractor plate sheet stock. The plates are formed of acrylic or other clear plastic and each has a top and bottom light eminating surface. The top member 32 has a light incident surface 36 (i.e., directed toward the light source) formed with a plurality of longitudinally extended side by side prisms 40 and a light emergent surface 38 (i.e., directed away from the light source) that is flat. Refractor plate member 32 is substantially co-extensive in length with the fluorescent tube 20. The refractor plates and lamps are preferably 48" long for use over a five foot desk although other size fixtures and lamps could be utilized.

The second refractor plate member 34 is substantially the same size as the first refractor plate member and co-extensive therewith. It too is formed of commercially available stock sheet plastic and has light incident and light emergent surfaces. The bottom surface 42 (i.e., the light emergent surface) of member 34 is flat and the top surface 44 (i.e., the light incident surface) of plate 34 contains thereon a series of side by side parallel prisms 46.

As shown in FIGS. 4 and 5, the prism bearing surfaces of plates 32 and 34 are both directed toward the lamp with the prisms of top plate 32 extending parallel to the lamp and the prisms of the bottom plate perpendicular to the lamps.

As pointed out above, the refractor plates members are formed from commercially available sheet stock. The prisms are designed to distribute light in a bat wing configuration which is a highly desirable light configuration. Such plates are available as "K-S-H 701 Lensmatic" produced by K-S-H, Inc., St. Louis, Missouri, as well as from other sources.

Referring to FIG. 6, it can be seen that the housing frame 18 is formed to define a front track 48 extending along the underside of the fixture at the fixture front and a rear track 50. The track supports the refractor members 32 and 34 in position, as shown below the light source. To this end the rear track 50 is provided with a lip 52 which captures the plates. The rear track is positioned so that it underlies the rear half of lamp 20. This aides in distributing the light flux on the desk top. Both tracks 48 and 50 are set upward from the bottom of the fixture so that the fixture front surface 54 blocks exposure of the refractor even if the lamp is raised considerably above the work surface.

When in use the lower lens 34 serves to spread the light flux eminating from the lamp along the desk from end to end. The upper lens 32 serves to spread the light flux along the desk from front to back.

Thus, in accordance with the above, the aforementioned objectives are effectively attained.

What is claimed is:

1. A work area lighting system comprising: a housing positioned above a work area, said housing having an open-bottom end; a linear light source mounted within said housing; a refractor for providing substantially uniform light distribution over the work area in the direction parallel to said light source as well as the direction transverse to the light source, said refractor comprising a pair of overlying plate members mounted to said housing closing said open bottom end, said refractor including first and second refractor plate members each substantially co-extensive in length with said light source; said first plate member having a light incident surface comprising a plurality of spaced prisms extending parallel to said linear light source; and said second plate member having a light incident surface comprising a plurality of spaced prisms extending perpendicular to said linear light source.

2. The system in accordance with claim 1 wherein said second plate member underlies said first plate member.

3. The system in accordance with claim 2 wherein said first and second plate light emergent surfaces are flat.

4. The system in accordance with claim 1 wherein said housing includes means thereon extending longitudinally and blocking approximately half said linear light source.

5. The system in accordance with claim 4 wherein said mentioned means comprises a track which supports said refractor.

6. The system in accordance with claim 5 wherein said track is set upward from said housing open bottom end and said housing further includes a front surface which extends below said track whereby said front surface effectively blocks from view said refractor when supported on said track.

* * * * *